US005548852A

United States Patent [19]

Rowe

[11] Patent Number: 5,548,852

[45] Date of Patent: Aug. 27, 1996

[54] PORTABLE SPA UNIT

[76] Inventor: Lee R. Rowe, 20050 Wellborm Rd., North Fort Myers, Fla. 33917

[21] Appl. No.: 305,208

[22] Filed: Sep. 13, 1994

[51] Int. Cl.[6] ..... E04H 4/12; A47K 3/02

[52] U.S. Cl. ..... 4/509; 4/541.4; 4/584

[58] Field of Search ..... 4/506, 507, 509, 4/541.1, 541.3, 541.4, 584, 585, 591, 593

[56] References Cited

U.S. PATENT DOCUMENTS

| | | | |
|---|---|---|---|
| 1,753,427 | 4/1930 | Phillips | 4/507 |
| 2,084,236 | 6/1937 | Babb | 4/507 |
| 3,720,964 | 3/1973 | Thomson | 4/506 X |
| 4,110,852 | 9/1978 | Kline | 4/509 X |
| 4,706,307 | 11/1987 | Smith | 4/506 X |
| 4,893,362 | 1/1990 | Murphy | 4/585 X |
| 4,932,558 | 6/1990 | Katavolos | 4/506 X |
| 5,408,707 | 4/1995 | Wilson | 4/585 X |

FOREIGN PATENT DOCUMENTS

| | | | |
|---|---|---|---|
| 0144338 | 9/1903 | Germany | 4/591 |

*Primary Examiner*—Robert M. Fetsuga
*Attorney, Agent, or Firm*—William E. Noonan

[57] ABSTRACT

A portable spa unit is disclosed, which unit includes a floor portion and a wall portion sealably connected to and extending upwardly from the floor portion to define an enclosed area for holding water. The wall portion includes an internal tubular framework and an outer skin that is supported by the framework. There are inlets and jets for communicably interconnecting the tubular framework and the enclosed area of the spa. A pump circulates water from the enclosed area of the spa into the framework through the inlets and then back into the enclosed area through the jets.

21 Claims, 4 Drawing Sheets

PORTABLE SPA UNIT

FIELD OF INVENTION

This invention relates to a portable spa unit and, more particularly, to a spa that employs an internal tubular framework, which both structurally supports the unit and conducts circulating water through the unit.

BACKGROUND OF THE INVENTION

In recent years, portable spas have become increasingly popular. However, conventional spas typically exhibit one or more of a number of problems. Most such units are composed of a synthetic insulating material covered by an external liner. These spas often do not exhibit the structural integrity, rigidity and durability that is desired for extended use of the unit. Additionally, conventional spa units usually exhibit an insufficient water circulation capacity because the number of jets are limited by the piping that is used. Indeed, in one known spa, shown in Popovich, U.S. Pat. No. 4,981,543, the circulating pipe for the unit extends outside of the tub and the circulating pump is contained in a separate and distinct housing. This unit employs only one pair of jets, which provide very limited circulation and hydrotherapy for bathers. Due to the small number of jets used, heating of the water may take an undesirably long time and such heating may be uneven. Moreover, the unit is undesirably bulky and difficult to transport and store. It also exhibits the lack of rigidity and structural integrity described above.

SUMMARY OF INVENTION

It is therefore an object of this invention to provide a portable spa unit that features an improved rugged, durable construction.

It is a further object of this invention to provide a portable spa unit that is lightweight and convenient to transport and store.

It is a further object of this invention to provide a portable spa unit that achieves prompt and even heating of the water in the spa and improved circulation and hydrotherapy for bathers.

It is a further object of this invention to provide a spa unit that employs an improved simplified and efficient construction for the walls of the spa.

It is a further object of this invention to provide a spa unit that reduces heat loss from and improves circulation of the water in the spa.

This invention results from a realization that a portable spa unit exhibiting improved structural integrity, heat retention and water circulation may be achieved by forming in the walls of the spa unit a tubular framework, which serves as both a structural support for the spa unit and a conductor for the circulating water in the unit.

This invention features a spa unit having a floor portion and a wall portion that is sealably connected to and extends upwardly from the floor portion to define an enclosed area for holding water. The wall portion includes an internal tubular framework and an outer skin that is supported by the framework. There are inlet means and jet means for communicably connecting the tubular framework and the enclosed area of the spa. Means are provided for circulating water from the enclosed area of the spa into the framework through the inlet means and then back into the enclosed area through the jet means.

In a preferred embodiment, the framework includes spaced apart, upper and lower peripheral tubular sections that generally surround the enclosed area of the spa and a plurality of transverse tubular elements that interconnect the upper and lower peripheral tubular sections. Each of the upper and lower peripheral tubular sections may include a ring-like configuration. Means may be provided for restricting water flow to a predetermined path through the framework. Such means for restricting may specifically prevent water from flowing into the upper peripheral tubular section. The inlet may be communicably mounted on the lower peripheral tubular section. The jet means may be communicably mounted on the transverse tubular elements. Such jet means may include a plurality of jet elements, each being mounted to a respective tubular element. The upper peripheral tubular section preferably includes air inlet means for introducing air into the upper peripheral tubular section. Air duct means may interconnect the upper peripheral tubular section with the jet means. Such duct means introduce air into the jet means when water is pumped through the jet means. Means may also be provided for filtering water that is circulated through the inlet means. The means for circulating typically include a pump that is entirely enclosed by the wall.

The skin may include a padded layer that is disposed about the framework. The padded layer may include a plurality of padded panels that are disposed about an inner periphery of the framework and a second plurality of padded panels that are disposed about an outer periphery of the framework. The padded layer and, in particular, the padded panels preferably comprise an insulating material such as a cross-linked foam. The padded layer may include a flexible element that covers an upper edge of the framework and extends between the first and second plurality of panels.

The skin may further include a flexible liner that covers the padded layer. Preferably, the liner includes an inner segment that is supported over the framework within the enclosed area and a distinct outer segment that is secured to the inner segment for covering an outer periphery of the framework. The floor portions may include an interior padded element and exterior liner.

DETAILED DESCRIPTION OF PREFERRED EMBODIMENTS

Other objects, features and advantages will occur from the following description of preferred embodiments and the accompanying drawings, in which.

Figure 1:
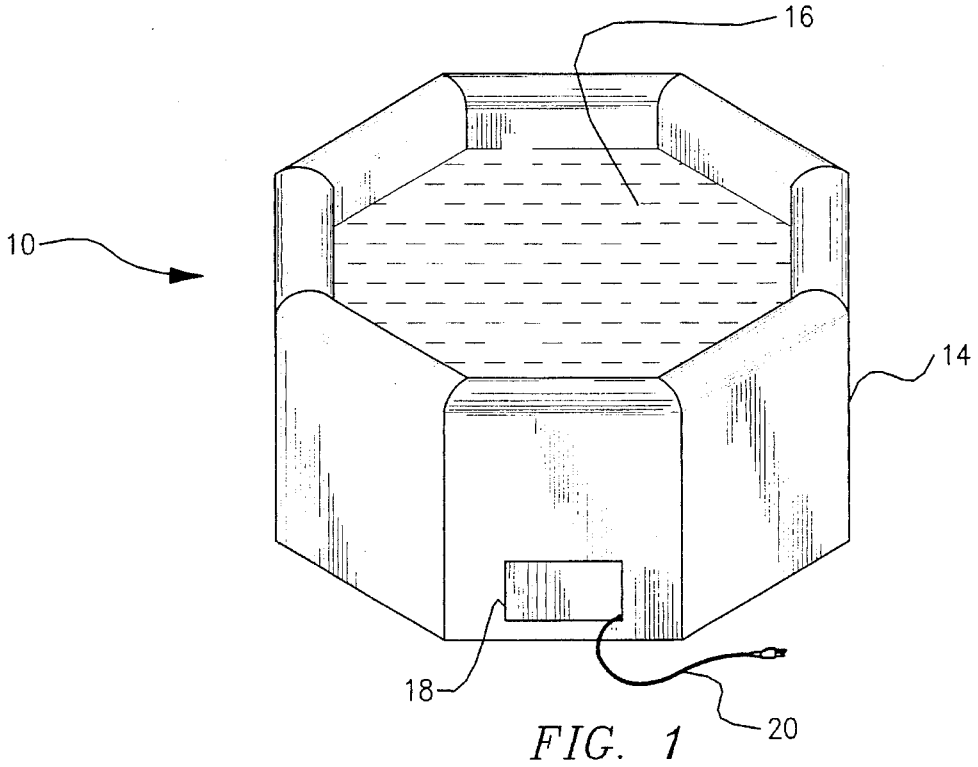
FIG. 1 is a perspective view of the portable spa unit of this invention.
Figure 2:
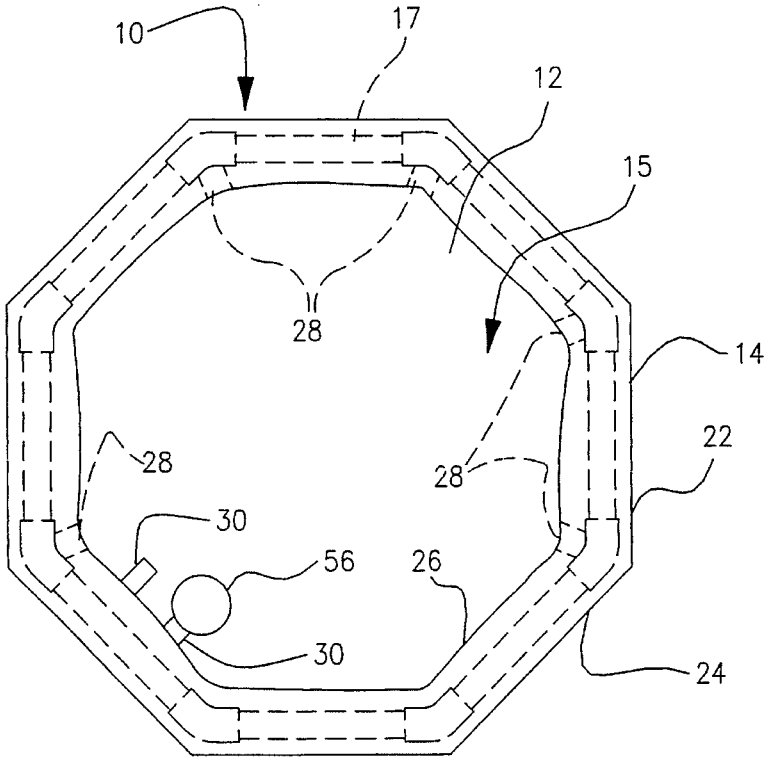
FIG. 2 is a top plan view of the spa unit, which specifically illustrates the internal framework and the outer skin.

There is shown in FIG. 1 a portable spa unit 10, which has a generally octagonal configuration. As further depicted in FIG. 2, spa 10 has a floor 12 and a peripheral wall 14 that is sealably attached to and extends upwardly from floor 12. A particular form of attachment is described more fully below. Floor 12 and wall 14 define an enclosed area 15 that is filled with water 16. This water is circulated through the spa for bathers. Such circulation is accomplished through a tubular framework 17, shown in phantom is FIG. 2, that is contained internally within wall 14.

Tubular framework 17 is covered by a waterproof skin 22, which forms an outer wall surface 24 and an inner wall surface 26. A plurality of water circulating jets 28 are communicably connected to framework 17 at respective vertices of the framework and extend through inward surface 26 of wall 22 into the enclosed area 15. A pair of water inlets 30 are likewise connected to the tubular framework at a section between a pair of adjacent vertices. Such inlets 30 extend from the tubular framework into the enclosed area 15 of spa 10. A removable panel 18, FIG. 1, is formed in the exterior wall surface 24. This panel provides access to a water circulating pump, a heating apparatus and related controls that circulate and heat the water during use of the spa. Power to the pump and heating units is provided by a conventional power cord and plug 20 that are connected to a standard household 110 volt outlet. Construction and operation of the circulation system are described more fully below.

The specific shape, dimensions and capacity of spa 10 may be varied as desired. However, for illustrative purposes, the following are representative specifications and dimensions that may be employed with the octagonally shaped unit that is shown in the drawings.

| | |
|---|---|
| Outer Diameter | 72 inches |
| Inner Diameter | 64 inches |
| Depth | 27 inches |
| Water Capacity | 280 gallons |
| Weight of Spa Unit without water | 65 lbs. |
| Seating capacity | 1–6 |

Although an octagonal unit is shown, it should be understood that various other shapes and configurations may be utilized. These may include circular and curved shapes and other polygonal configurations.

Figure 3:
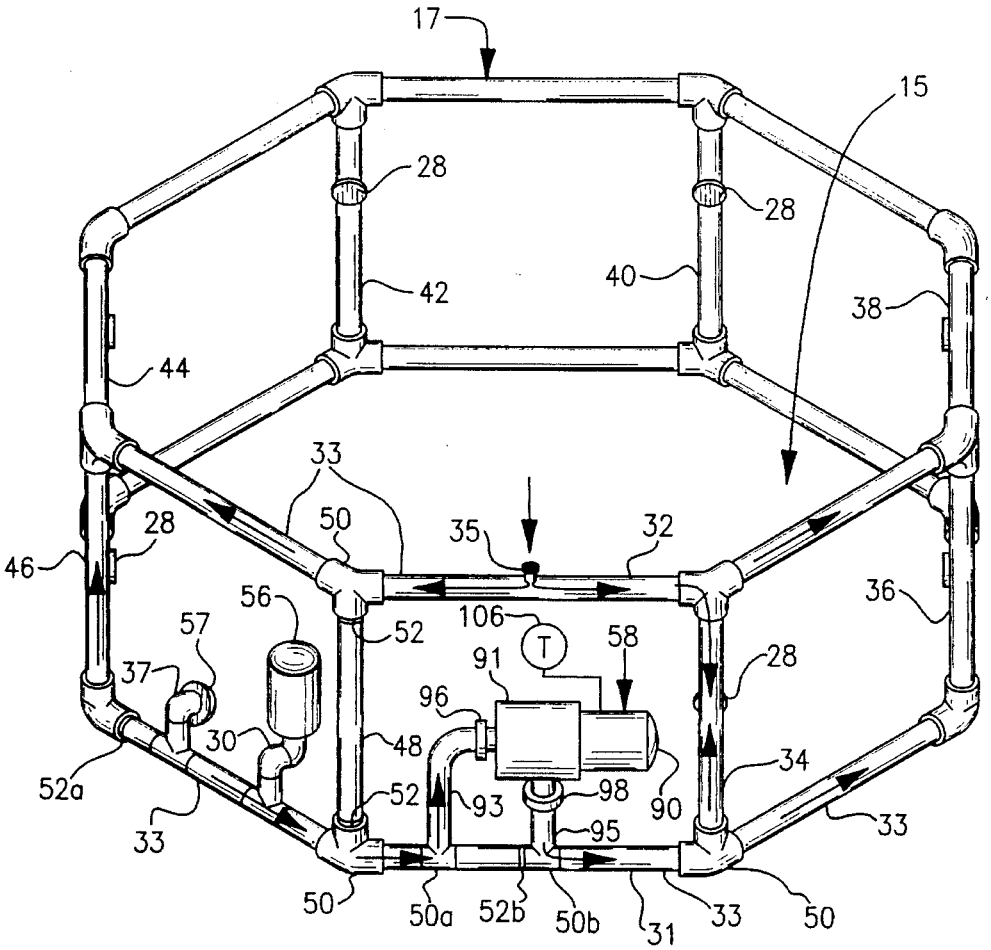
FIG. 3 is a perspective view of the tubular framework with the inlets, jets and circulation pump apparatus attached thereto.

The tubular framework 17, with its exterior skin removed, is shown in FIG. 3. Framework 17 includes a plurality of interconnected tubular segments. These tubular segments preferably comprise PVC pipe or other durable pipe constructions that are suitable for both conducting water and providing structural integrity for the spa unit. More particularly, the framework includes a lower peripheral tubular section 31 that is proximate the floor, ground or other flat supporting structure and a similarly shaped upper peripheral tubular section 32 that is spaced above section 31. Each peripheral tubular section includes a plurality of elongate tubular elements 33 that are connected in an end to end arrangement through 45° PVC T-connectors 50. The peripheral tubular sections have similar octagonal shapes, although other shapes may be substituted to conform to the desired peripheral shape of the spa. Each of sections 31 and 32 generally surrounds the enclosed area 15. The peripheral sections are spaced apart and interconnected by eight transverse tubular sections 34, 36, 38, 40, 42, 44, 46 and 48. Each of the transverse tubular elements is communicably interconnected to the upper peripheral tubular section 32 by a respective T-connector 50 that is secured to an upper end of the transverse element. Similarly, the lower end of each transverse tubular element is communicably connected to the lower peripheral tubular section 31 by a respective T-connector 50. As will be described more fully below, the bottom peripheral tubular section 31 is intended for conducting circulating water. The upper peripheral tubular section 32 includes one or more air inlet valves 35 for introducing air into the framework. Such air is employed in the jets 28, as described more fully below.

Circulating jets 28 are operably and communicably interconnected to transverse elements 34–44. In alternative embodiments, more or less jets may be mounted to respective transverse tubular elements in other arrangements or schemes. Jets 28 are hydrotherapy jets that operate in a manner well known in the spa industry. A dome cap plug 52 is fitted into the upper and lower ends of each of the transverse tubular elements that do not carry a jet 28. This plug, which is described more fully below, prevents circulating water from being pumped into the upper peripheral tubular section 32. As a result, the upper section accommodates only air.

Water inlets 30 and 37 are communicably connected to one of the tubular segments 33 of lower tubular section 31. Inlets 30 and 37 extend into the enclosed area 15 of the spa. A conventional spa filter 56 is attached in a known manner to one of the inlets 30 and a suction stainer 57 is attached to the other inlet 37.

A circulating pump/heating apparatus 58 is communicably interconnected in lower peripheral tubular section 31. Apparatus 58 draws water from the spa into tubular framework 17 through inlets 30. The apparatus then heats that water to the degree desired and pumps the water through the framework and out through jets 28 into the enclosed area of the spa. The construction and operation of the pump/heating apparatus 58 is described more fully below.

A plug **52*a* is formed in the side of tubular section 31 that carries inlets 30 and 37. Plug 52*a* is positioned upstream of inlets 30 and 37 and prevents apparatus 58 from sucking in water that has already been pumped through framework 17. The plug ensures that apparatus 58 draws water in only from the enclosed area 15 through inlets 30 and 37**.

Figure 4:
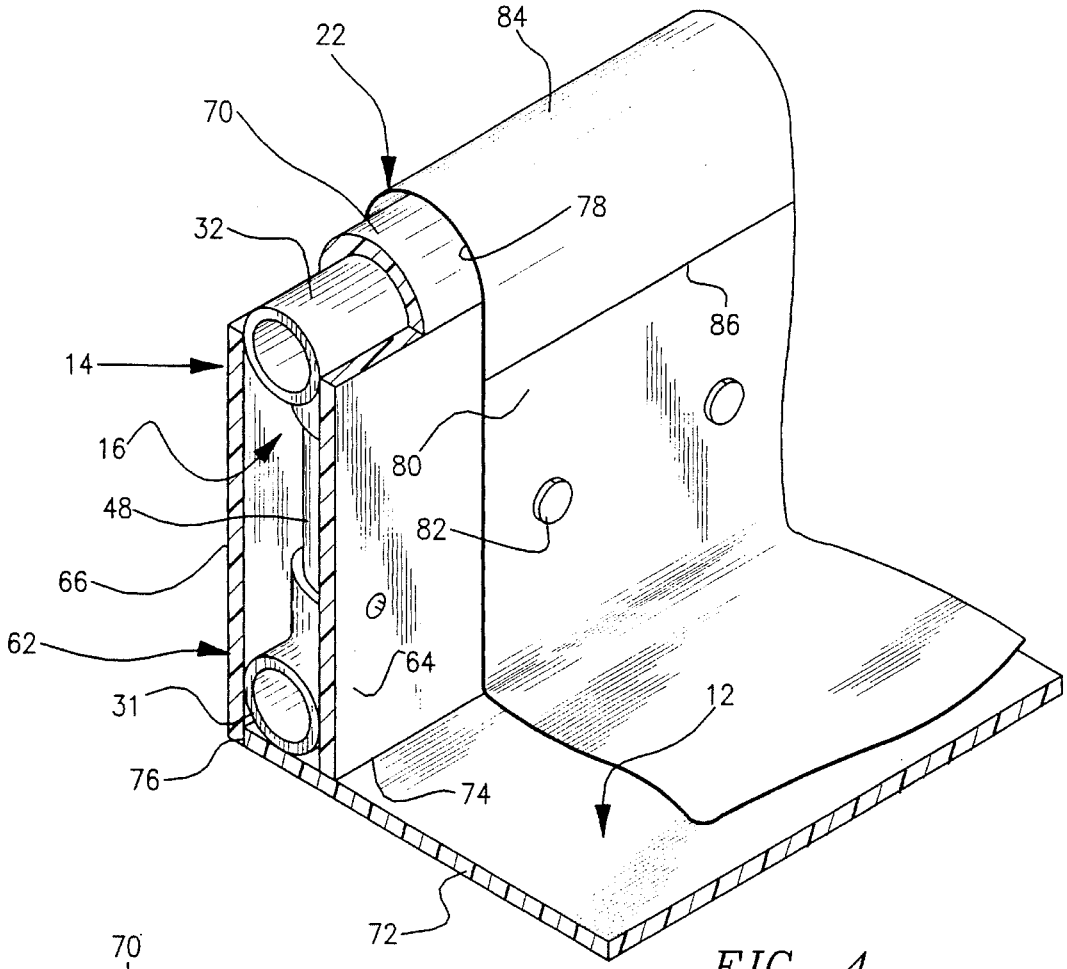
FIG. 4 is a perspective cross sectional view, taken along a vertex of the spa unit and illustrating the construction of the wall and floor. For clarity, no jets are illustrated.
Figure 5:
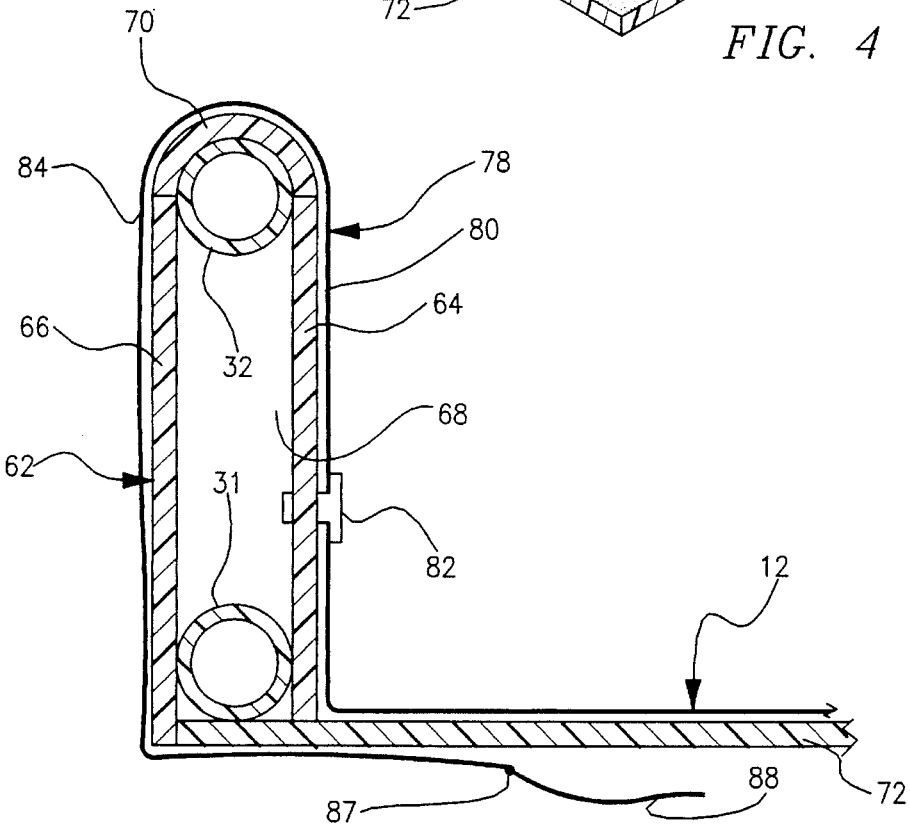
FIG. 5 is a cross sectional view of the wall of the spa, between the vertices, and a portion of the floor of the unit.

As illustrated in FIGS. 4 and 5, skin 22 of wall 14 includes a padded layer 62 that is disposed on either side of tubular framework 17. More particularly, padded layer 62 includes a first plurality of insulated foam panels 64 that are disposed along the inner periphery of framework 17. A second plurality of insulating foam panels 66 are formed along the outer periphery of the framework. Each panel preferably comprises a piece of ½" polyethylene foam, although various other thicknesses and compositions may be employed. Each piece generally conforms to one of the sides of the octagonal framework and engages the upper and lower peripheral tubular sections 31 and 32 and the respective tubular sections 34–48 that define the vertices of the spa. As best shown in FIG. 5, a dead air space 68 is formed in the region between panels 64 and 66. This provides significantly improved insulation and reduces heat loss from the water in the spa unit.

Padded layer 62 also includes a flexible element 70, which is composed of an insulating foam wrapped over upper tubular section 32. Element 70 extends between insulating panels 64 and 66. This further insulates the unit and provides for a comfortable head rest around the upper edge of wall 14.

Floor 12 includes a flat piece of cross-linked foam 72 that extends beneath the lower end of inside foam panel 64 and beneath the tubular framework 17. The edge of foam piece 72 abuts the inside surface of the outer foam panels 62. Floor piece 72 is firmly secured to panels 64 and 66 by an appropriate waterproof foam adhesive applied along junctions 74 and 76 (FIG. 4).

Skin 22 also includes a flexible liner 78 that covers padded layer 62. Liner 78 includes an inner waterproof segment 80 that is composed of reinforced polyester or a similar material that is both comfortable and durable. Even more importantly this reinforcement provides necessary tensile and hoop strength for the liner. Segment 80 extends over most if not all of the inward facing surface of panels 64 and across the upper surface of floor pad 72. Liner 78 also includes a distinct outer segment 84 that is permanently attached to segment 80 along line 86 by heat welding or other means along line 86. Segment 84, which comprises a marine grade vinyl canvas or similar construction is wrapped over padded segment 70 and across the outwardly facing surfaces of panels 66. The liner includes a lower edge 87 that extends beneath the floor 12 of the spa unit. Edge 87 is provided with a drawstring 88 that may be manipulated in a known manner to tighten or loosen the liner over the padded layer 62. By opening the drawstring sufficiently, the outer segment 84 of liner 80 may be removed to uncover foam panels 66. The foam panels can then be removed to provide access to the tubular framework. As a result, necessary repairs and maintenance may be performed quickly and conveniently. The drawstring construction also permits the liner to be repaired or replaced as required.

Figure 6A:
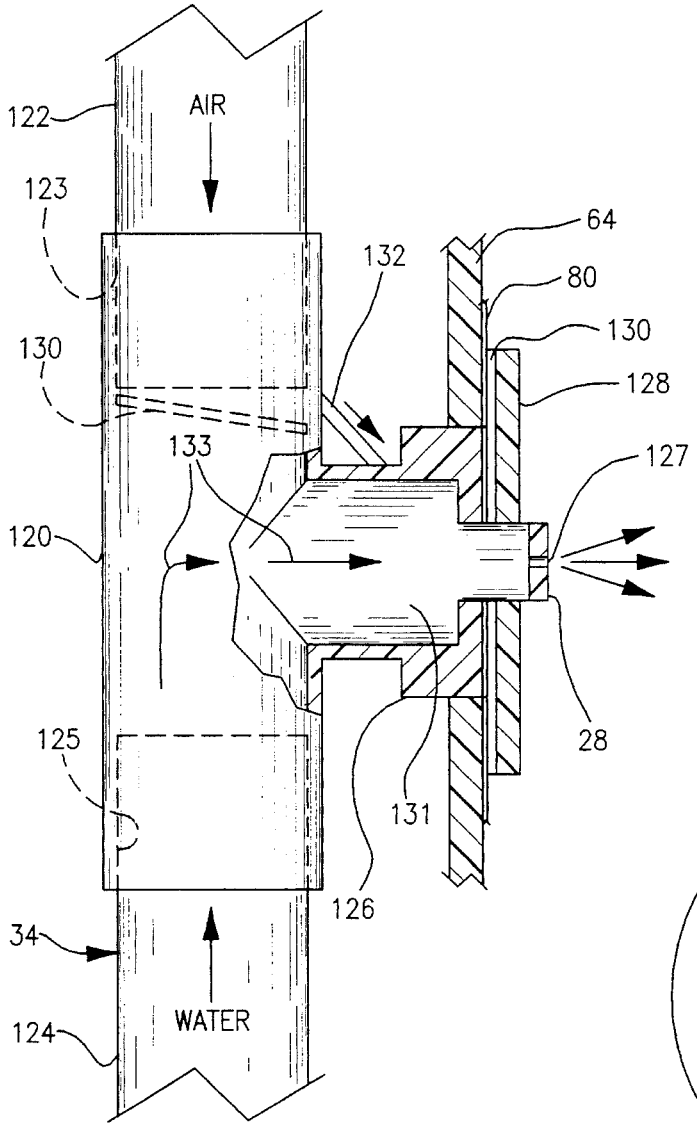
FIG. 6A is a side, partly cross sectional view of one of the circulating jets, as attached to the tubular framework and extending through the skin of the spa unit.
Figure 6B:
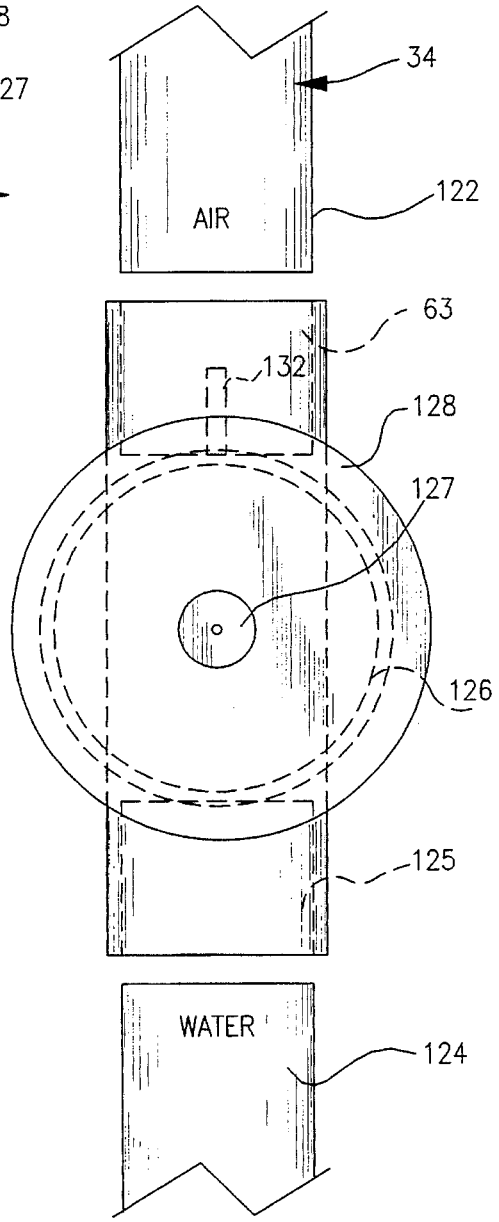
FIG. 6B is a front, elevational, partly exploded view of the circulating jet.

A representative one of the jets is shown in FIGS. 6A and 6B. Each jet includes a tubular connector section 120 that forms a portion of a respective transverse section 34–44. For illustrative purposes, transverse section 34 is shown in FIGS. 6A and 6B. More particularly, tubular section 120 receives a first pipe segment 122 that is communicably connected to the upper, air conducting peripheral section 32, and a second pipe segment 124 that is communicably connected to the lower, water conducting peripheral section 31. Pipe segments 122 and 124 are received in respective end sockets 123 and 125 of tubular section 120 and are secured therein by an appropriate adhesive. A transverse jet section 126 is communicably and unitarily connected to tubular section 120. Jet section 126 extends through insulated panel 64 and engages the interior, hidden surface of liner 80. The transverse jet section carries a conventional jet nozzle 127 that extends through liner 80 and faces the interior of the spa. A face plate 128 encircles nozzle 127 and engages the inwardly facing, exposed surface of liner 80 such that the face plate abuts the distal surface of jet section 126. A gasket 130 is interposed between face plate 128 and liner 80. This face plate and nozzle construction is conventional in the spa art.

Tubular section 120 includes an interior bore that communicates with socket 125 and thereby with pipe segment 124. The bore of the tubular section 120 also communicates with the interior channel 131 of transverse jet section 126. On the other hand, a dam or plug 130 is formed in section 120 to block communication between the tubular section and the air conducting pipe segment 122. Instead, an air venturi tube 132 communicably interconnects the interior of tubular section 120 above plug 130 with the interior channel 131 of transverse jet section 126. As a result, when water is pumped through jet apparatus 28 and specifically, through channel 131, as indicated by arrows 133, the water passes the opening of venturi tube 132. This creates a venturi effect which provides a jet spray through nozzle 127.

Figure 7:
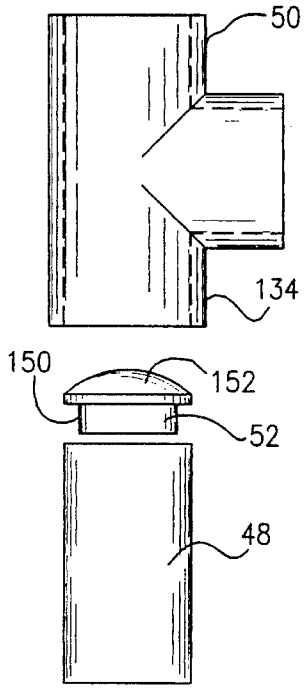
FIG. 7 is an exploded perspective view of one of the transverse tubular elements with a water restricting plug inserted therein.

A representative one of the dome cap plugs 52 is shown in FIG. 7. Plug 52 has a diameter of approximately 1½". A cylindrical portion 150 is received in one end of a respective elongate pipe segment 48. Dome portion 152 is received in a lower branch 154 of T-connector 50. An appropriate PVC pipe adhesive is used to secure plug 52 in place. As shown in FIG. 3, plugs 52 are connected in this manner to the upper and lower ends of transverse section 48. This prevents air from entering tubular section 48 from upper peripheral section 32 and likewise prevents water from entering section 48 from lower peripheral section 31.

Pumping/heating apparatus 58 is shown in FIG. 3. Apparatus 58 is uniquely located within the outer wall surface of the insulated skin of the spa walls. As a result a neat, attractive appearance is achieved and heat losses are minimized. Otherwise, the pump construction is largely conventional and has been used in previous spas. Specifically, apparatus 58 includes a pump 90 that is mounted within the tubular framework 16. Access to apparatus 58 is provided through removable panel 18, FIG. 1. As illustrated in FIG. 3, pump 90 is operably connected to a union 91. The union has an inlet 96 that receives water from lower peripheral section 31 through T-connector 50*a* and a tubular elbow 93. The union also includes an outlet 98 that directs circulating water downstream to section 31 through pipe segment 95 and T-connector 50*b*. As indicated by the arrows, water proceeds up through the transverse tubular elements 34–44 to the respective circulating jets 28. A plug 52*b* is mounted in the manner previously described in lower peripheral section 31, between T-connectors 50*a* and 50*b*, so that water is restricted to flowing through union 91.

Pump 90 includes a conventional heat exchanger comprising a coil that is wrapped around the pump motor. At least some of the pumped water is directed from union 91 through this coil. This water picks up heat from the motor. The heated water is then directed through union outlet 98 to peripheral section 31 and jets 28. The heat exchanger coils may be secured to the motor by an appropriate heat transfer mastic, which increases heating efficiency.

Heating is more particularly controlled by a thermostat 106 that causes the pump 90 to be activated when the water temperature falls below a predetermined level. A timer may be employed to automatically deactivate the pump after 10 minutes so that overheating of the water and energy inefficiency are avoided. The controls for operating the pump will be understood to those skilled in the art.

In operation, unit 10 is set up on a floor or flat base in an appropriate location and is then filled with water 16. The spa is connected to a standard electrical outlet and a desired temperature is set on thermostat 106. As a result, pump 90 draws water from the spa into the internal tubular framework 17 through inlets 30 and 37. This water is pumped though the lower peripheral tubular section 31 and heated as described above. The water is then directed up into the transverse tubular elements 34–46 and through the jets 28 back into the enclosed area 15 of spa unit 10. This generates a heated water circulation, which is therapeutic and relaxing for bathers. Air is pulled into the jets through air inlets 35 and venturi tubes 132 and this air mixes with the water to form an effective jet spray. The tubular framework and insulated foam layer construction provide for both effective water circulation and minimal heat loss through the walls of the spa unit.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A spa unit comprising:

a floor portion;

a wall portion sealably connected to and extending upwardly from said floor portion and defining an enclosed area for holding water; said wall portion including an internal tubular framework and an outer skin that is supported by said framework, said framework including spaced apart upper and lower peripheral tubular sections that generally surround said enclosed area of said spa and a plurality of transverse tubular elements that interconnect said upper and lower peripheral sections;

inlet means and jet means each for communicably interconnecting said tubular framework and said enclosed area of said spa; and means for circulating water from the enclosed area of said spa into said framework through said inlet means and then back into said enclosed area through said jet means, said means for circulating including a pump that is at least partly enclosed by said tubular framework.

2. The unit of claim 1 further including means for restricting water from flowing into said upper peripheral tubular section.

3. The unit of claim 1 in which said inlet means are communicably mounted on said lower peripheral tubular section.

4. The unit of claim 1 in which said jet means are communicably mounted on said transverse tubular elements.

5. The unit of claim 4 in which said jet means include a plurality of jet elements, each being mounted to a respective said transverse tubular element.

6. The unit of claim 1 in which said skin includes a padded layer that is disposed about said framework.

7. The unit of claim 6 in which said layer includes a first plurality of padded panels disposed about an inner periphery of said framework and a second plurality of padded panels disposed about an outer periphery of said framework.

8. The unit of claim 7 in which said padded layer includes a flexible element covering an upper edge of said framework and extending between said first and second plurality of panels.

9. The unit of claim 6 in which said padded layer comprises foam.

10. The unit of claim 6 in which said padded layer includes an insulating material.

11. The unit of claim 6 in which said skin includes a flexible liner that covers said padded layer.

12. The unit of claim 11 in which said liner includes an inner waterproof segment that is supported over said framework within said enclosed area and distinct outer segment that is secured to said inner segment for covering an outer periphery of said framework.

13. The unit of claim 1 in which said floor portion includes an interior padded element and an exterior liner.

14. A spa unit comprising:

a floor portion;

a wall portion sealably connected to and extending upwardly from said floor portion to define an enclosed area for holding water; said wall portion including an internal tubular framework and an outer skin that is supported by said framework; said framework including spaced apart upper and lower peripheral tubular sections that generally surround said enclosed area of said spa and a plurality of transverse tubular elements that interconnect said upper and lower peripheral tubular sections;

inlet means and jet means each for communicably interconnecting said tubular framework and said enclosed area of said spa; said jet means being communicably mounted on said transverse tubular elements; and means for circulating water from the enclosed area of said spa into said framework through said inlet means and then back into said enclosed area through said jet means.

15. A spa unit comprising:

a floor portion;

a wall portion sealably connected to and extending upwardly from said floor portion to define an enclosed area for holding water;

said wall portion including an internal tubular framework and an outer skin that is supported by said framework; said framework including spaced apart upper and lower peripheral tubular sections that generally surround said enclosed area of said spa and a plurality of transverse tubular elements that interconnect said upper and lower peripheral tubular sections;

inlet means and jet means each for communicably interconnecting said tubular framework and said enclosed area of said spa; said inlet means including at least one inlet communicably mounted on said lower peripheral tubular section; and means for circulating water from the enclosed area of said spa into said framework through said inlet means and then back into said enclosed area through said jet means.

16. A spa unit comprising:

a floor portion;

a wall portion sealably connected to and extending upwardly from said floor portion to define an enclosed area for holding water;

said wall portion including an internal tubular framework and an outer skin that is supported by said framework; said framework including spaced apart upper and lower peripheral tubular sections that generally surround said enclosed area of said spa and a plurality of transverse tubular elements that interconnect said upper and lower peripheral tubular sections;

inlet means and jet means each for communicably interconnecting said tubular framework and said enclosed area of said spa;

means for restricting water from flowing into said upper peripheral section; and means for circulating water from said enclosed area of said spa into said framework through said inlet means and then back into said enclosed area through said jet means.

17. A spa unit comprising:

a floor portion;

a wall portion sealably connected to and extending upwardly from said floor portion to define an enclosed area for holding water;

said wall portion including an internal tubular framework and an outer skin that is supported by said framework; said framework including spaced apart upper and lower peripheral tubular sections that generally surround said enclosed area of said spa and a plurality of transverse tubular elements that interconnect said upper and lower peripheral tubular sections;

inlet means and jet means each for communicably interconnecting said tubular framework and said enclosed area of said spa;

means for circulating water from the enclosed area of said spa into said framework through said inlet means and then back into said enclosed area through said jet means;

said upper peripheral tubular section including at least one air inlet for introducing air into said upper peripheral tubular section.

18. The unit of claim 17 wherein one of said tubular elements includes a connector section having an air venturi to communicably interconnect the upper peripheral tubular section with the jet means and introduce air into the jet means when water is pumped through the jet means.

19. A spa unit comprising:

a floor portion;

a wall portion sealably connected to and extending upwardly from said floor portion to define an enclosed area for holding water; said wall portion including an internal tubular framework and an outer skin that is supported by said framework; said skin including a padded layer that is disposed about said framework, said layer including a first plurality of padded panels disposed about an inner periphery of said framework and a second plurality of padded panels disposed about an outer periphery of said framework; inlet means and jet means each for communicably interconnecting said tubular framework and said enclosed area of said spa; and means for circulating water from said enclosed area of said spa into said framework through said inlet means and then back into said enclosed area through said jet means.

20. The unit of claim 19 in which said flamework includes spaced apart upper and lower peripheral tubular sections that generally surround said enclosed area of said spa and a plurality of transverse tubular elements that interconnect said upper and lower peripheral tubular sections.

21. The unit of claim 20 in which said upper peripheral tubular section includes at least one air inlet for introducing air into said upper peripheral tubular section.

* * * * *